US009353327B2

(12) United States Patent
Li

(10) Patent No.: US 9,353,327 B2
(45) Date of Patent: May 31, 2016

(54) DIESEL ENGINE OILS

(71) Applicant: Yue-Rong Li, Albany, CA (US)

(72) Inventor: Yue-Rong Li, Albany, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 13/712,349

(22) Filed: Dec. 12, 2012

(65) Prior Publication Data

US 2013/0157911 A1 Jun. 20, 2013

Related U.S. Application Data

(60) Provisional application No. 61/576,916, filed on Dec. 16, 2011.

(51) Int. Cl.

| | |
|---|---|
| ***C10M 129/26*** | (2006.01) |
| ***C10M 135/10*** | (2006.01) |
| ***C10M 159/16*** | (2006.01) |
| ***C10M 105/22*** | (2006.01) |
| ***C10M 133/44*** | (2006.01) |
| ***C10M 163/00*** | (2006.01) |

(52) U.S. Cl.

CPC ..... *C10M 133/44* (2013.01); *C10M 163/00* (2013.01); *C10M 2203/1006* (2013.01); *C10M 2207/026* (2013.01); *C10M 2207/028* (2013.01); *C10M 2207/26* (2013.01); *C10M 2207/262* (2013.01); *C10M 2215/064* (2013.01); *C10M 2215/28* (2013.01); *C10M 2217/043* (2013.01); *C10M 2227/066* (2013.01); *C10N 2210/02* (2013.01); *C10N 2230/04* (2013.01); *C10N 2240/102* (2013.01)

(58) Field of Classification Search

CPC ..... C10M 2207/028; C10M 133/56; C10M 133/44; C10M 163/00; C10M 2227/066; C10M 2207/26; C10M 2217/043; C10M 2203/1006; C10M 2215/064; C10M 2207/026; C10M 2215/28; C10M 2207/262; C10N 2230/04; C10N 2210/02; C10N 2240/102

USPC ..... 508/192, 287, 391, 435, 460, 574, 58

See application file for complete search history.

(56) References Cited

U.S. PATENT DOCUMENTS

| | | | | |
|---|---|---|---|---|
| 2,197,832 | A | 4/1940 | Reiff | |
| 2,680,096 | A | 6/1954 | Walker et al. | |
| 3,178,368 | A | 4/1965 | Hanneman | |
| 3,801,507 | A | 4/1974 | Hendrickson et al. | |
| 4,744,921 | A | 5/1988 | Liston | |
| 5,024,773 | A | 6/1991 | Liston | |
| 5,292,968 | A * | 3/1994 | Ueda et al. | 568/716 |
| 5,318,710 | A | 6/1994 | Campbell | |
| 5,320,762 | A | 6/1994 | Campbell | |
| 5,320,763 | A | 6/1994 | Campbell | |
| 6,140,282 | A * | 10/2000 | Cartwright et al. | 508/398 |
| 6,162,770 | A * | 12/2000 | Le Coent et al. | 508/460 |
| 7,163,911 | B2 | 1/2007 | Boons et al. | |
| 7,563,751 | B2 | 7/2009 | Yagishita | |
| 7,687,444 | B2 * | 3/2010 | Nagamatsu | 508/460 |
| 2002/0183212 | A1 | 12/2002 | Hammong et al. | |
| 2003/0191032 | A1 | 10/2003 | Deckman et al. | |
| 2003/0195126 | A1 | 10/2003 | Boons | |
| 2005/0153848 | A1 | 7/2005 | Bell et al. | |
| 2006/0052254 | A1 | 3/2006 | Shaw | |
| 2006/0052259 | A1 * | 3/2006 | Le Coent et al. | 508/460 |
| 2007/0027045 | A1 * | 2/2007 | Kleijwegt | 508/518 |
| 2007/0117724 | A1 | 5/2007 | Cartwright | |
| 2007/0184992 | A1 * | 8/2007 | Takeuchi et al. | 508/287 |
| 2009/0143261 | A1 * | 6/2009 | Takeoka et al. | 508/110 |
| 2011/0207639 | A1 * | 8/2011 | Carey et al. | 508/391 |
| 2011/0245120 | A1 | 10/2011 | Bertram et al. | |

FOREIGN PATENT DOCUMENTS

| | | | |
|---|---|---|---|
| EP | 1256619 | | 11/2002 |
| EP | 2290041 | A2 | 3/2011 |
| JP | 11029784 | A * | 2/1999 |
| JP | 3925978 | | 3/2007 |
| JP | 2007217607 | | 8/2007 |

OTHER PUBLICATIONS

Search Report issued in counterpart European Patent Application No. 12856736.9 dated May 11, 2015.

* cited by examiner

*Primary Examiner* — Pamela H Weiss

(74) *Attorney, Agent, or Firm* — M. Carmen & Associates, PLLC

(57) ABSTRACT

A lubricating oil additive composition comprising at least one carboxylate detergent wherein at least one of the carboxylate detergents has a TBN of the actives of greater than about 60 to about 200; at least one polyalkenyl succinimide; a first phenate detergent having a TBN of the actives of greater than about 60 to about 200; and a second phenate detergent having a TBN of the actives of greater than about 200 to about 400.

24 Claims, No Drawings

DIESEL ENGINE OILS

CROSS-REFERENCED AND RELATED APPLICATIONS

This application is a nonprovisional application of U.S. Provisional Patent Application No. 61/576,916 filed in the United States Patent and Trademark Office on Dec. 16, 2011. Said U.S. Provisional Patent Application No. 61/576,916 is, in its entirety, incorporated into this application by reference.

FIELD OF INVENTION

The present invention relates to lubricating oil compositions. More specifically, it relates to lubricating oil compositions for use in railroad diesel engines or inland marine engines.

BACKGROUND OF THE INVENTION

Lead bearing corrosion in locomotive engines has been one of the major concerns for original equipment manufacturers (OEMs). Total Base Number (TBN) retention has also been a technical challenge. Historically, railroad engine oils (RREO) are non-zinc containing formulations because of the silver bearings which were used in some locomotive engines. Without the benefit of zinc dialkyl dithiophosphate, the proper detergent mixture has been the key factor in control of TBN retention and lead corrosion.

In March 2008, the Environmental Protection Agency (EPA) finalized a three-part program that will dramatically reduce emissions from diesel locomotives of all types—line-haul, switch, and passenger rail. The rule will decrease particulate matter (PM) emissions from these engines by as much as 90 percent and NOx emissions by as much as 80 percent when fully implemented. This final rule sets new emission standards for existing locomotives when they are remanufactured. The rule also sets Tier 3 emission standards for newly-built locomotives, provisions for clean switch locomotives, and idle reduction requirements for new and remanufactured locomotives. Finally, the rule establishes long-term, Tier 4, standards for newly-built engines based on the application of high-efficiency catalytic after treatment technology, beginning in 2015.

Due to new EPA emission requirements and the introduction of ultra low sulfur diesel (ULSD) fuel, there will be a move to low SAPS railroad engine oils. As in heavy duty diesel oils for truck engines, there will be a decrease in TBN as well as a reduction in sulfur levels. Traditionally RREOs were 13-17 TBN oils.

The TBN will likely be lowered to 8-11 TBN due to these changes. Balancing reductions in TBN and sulfur with long standing concerns about TBN retention and lead corrosion will require a different formulation. It has been found that when TBN levels were lowered, but the components were not changed, TBN retention and lead corrosion levels suffered. A problem exists of maintaining or improving lead corrosion and TBN retention when TBN in the oils and sulfur are decreased in RREOs.

It has been discovered that formulations containing salicylate detergent in addition to the traditional components showed decreased levels of lead corrosion and better BN retention.

1. Prior Art

Research Disclosure No. RD0493012 teaches the use of salicylate detergents and supplementary antioxidants for improved lead corrosion in low sulfated ash, phosphorus and sulfur heavy-duty diesel formulations.

Tomomi et al, JP 3925978 teaches a composition which comprises lubricating base oil, (a) perbasic alkali earth metal salicylate, (b) perbasic alkali earth metal phenate and (c) bis-type alkenyl succinimide, bis-type alkyl succinimide or their boron adducts.

Locke, EP 1256619 teaches a lubricating oil composition comprising (A) an oil of lubricating viscosity, in a major amount, and added thereto, (B) a detergent composition comprising one or more metal detergents which comprises metal salts of organic acids, in a minor amount, wherein the detergent composition comprises more than 50 mole % of a metal salt of an aromatic carboxylic acid, based on the moles of the metal salts of organic acids in the detergent composition, and (C) one or more co-additives, in a minor amount; wherein the total amounts of phosphorus and sulfur derived from (B) or (C) or both (B) and (C) are less than 0.1 mass % of phosphorus and at most 0.5 mass % of sulfur, based on the mass of the oil composition.

Shaw, U.S. Published Patent Application 2006/0052254 teaches an oil composition, which contains a salicylate, having sulfur (up to 0.3 wt %), phosphorus (up to 0.08 wt %), sulfated ash (up to 0.80 wt %), comprises a mixture of an oil of lubricating viscosity (a); and an overbased alkali or alkaline earth metal alkyl salicylate lubricating oil detergent (b) having salicylate soap (20-25 wt %).

Reiff, U.S. Pat. No. 2,197,832 teaches a mineral oil composition which incorporates a small quantity of a multifunctional compound selected from that group of class of metalorganic compounds which is referred to as the oil-soluble or oil-miscible metal salts of alkyl-substituted hydroxyaromatic carboxylic acids.

Yagishita, U.S. Pat. No. 7,563,751 teaches a lubricating oil composition comprising a base oil having a sulfur content adjusted to 0.1 wt % or less, and at least one of two different alkali or alkali earth metal salicylate mixtures.

Yasushi, Japanese Patent No., JP 2007217607 teaches a diesel engine oil which contains mineral oil and/or synthetic oil as base oil, salicylate type cleaning agent (1-8 mass %) and diphenylamine derivative (0.005-0.03 mass %) as additive.

SUMMARY OF THE INVENTION

One embodiment of the present invention is directed to a lubricating oil additive composition comprising a. at least one carboxylate detergent wherein at least one of the carboxylate detergents has a TBN of the actives of greater than about 60 to about 200;
b. at least one polyalkenyl succinimide;
c. a first phenate detergent having a TBN of the actives of greater than about 60 to about 200; and
d. a second phenate detergent having a TBN of the actives of greater than about 200 to about 400.

One embodiment of the present invention is directed to a lubricating oil composition comprising a. a major amount of oil of lubricating viscosity;
b. at least one carboxylate detergent wherein at least one of the carboxylate detergents has a TBN of the actives of greater than about 60 to about 200;
c. at least one polyalkenyl succinimide;
d. a first phenate detergent having a TBN of the actives of greater than about 60 to about 200; and
e. a second phenate detergent having a TBN of the actives of greater than about 200 to about 400.

One embodiment of the present invention is directed to a method for operating a diesel locomotive engine comprising lubricating said diesel locomotive engine with a lubricating oil composition comprising a. a major amount of an oil of lubricating viscosity;
b. at least one carboxylate detergent wherein at least one of the carboxylate detergents has a TBN of the actives of greater than about 60 to about 200;
c. at least one polyalkenyl succinimide;
d. a first phenate detergent having a TBN of the actives of greater than about 60 to about 200; and
e. a second phenate detergent having a TBN of the actives of greater than about 200 to about 400.

One embodiment of the present invention is directed to a method of improving TBN retention wherein the lubricating oil composition comprises a. a major amount of an oil of lubricating viscosity;
b. at least one carboxylate detergent wherein at least one of the carboxylate detergents has a TBN of the actives of greater than about 60 to about 200;
c. at least one polyalkenyl succinimide;
d. a first phenate detergent having a TBN of the actives of greater than about 60 to about 200; and
e. a second phenate detergent having a TBN of the actives of greater than about 200 to about 400.

One embodiment of the present invention is directed to a method for operating a diesel locomotive engine comprising lubricating said diesel locomotive engine with a lubricating oil composition comprising a. a major amount of an oil of lubricating viscosity; and
b. at least one carboxylate detergent wherein at least one of the carboxylate detergents has a TBN of the actives of greater than about 60 to about 200;
c. at least one polyalkenyl succinimide;
d. a first phenate detergent having a TBN of the actives of greater than about 60 to about 200; and
e. a second phenate detergent having a TBN of the actives of greater than about 200 to about 400.

One embodiment of the present invention is directed to a method for operating an inland marine engine comprising lubricating said inland marine engine with a lubricating oil composition comprising a. a major amount of an oil of lubricating viscosity; and
b. at least one carboxylate detergent wherein at least one of the carboxylate detergents has a TBN of the actives of greater than about 60 to about 200;
c. at least one polyalkenyl succinimide;
d. a first phenate detergent having a TBN of the actives of greater than about 60 to about 200; and
e. a second phenate detergent having a TBN of the actives of greater than about 200 to about 400

One embodiment of the present invention is directed to a A method of improving TBN retention comprising lubricating an engine with a lubricating oil composition having a major amount of an oil of lubricating viscosity;

a. at least one carboxylate detergent wherein at least one of the carboxylate detergents has a TBN of the actives of greater than about 60 to about 200;
b. at least one polyalkenyl succinimide;
c. a first phenate detergent having a TBN of the actives of greater than about 60 to about 200; and
d. a second phenate detergent having a TBN of the actives of greater than about 200 to about 400.

DETAILED DESCRIPTION OF THE INVENTION

DEFINITIONS

The term "alkaline earth metal" refers to calcium, barium, magnesium, strontium, or mixtures thereof.

The term "alkyl" refers to both straight- and branched-chain alkyl groups.

The term "metal" refers to alkali metals, alkaline earth metals, transition metals or mixtures thereof.

The term "Metal to Substrate ratio" refers to the ratio of the total equivalents of the metal to the equivalents of the substrate. An overbased sulphonate detergent typically has a metal ratio of 12.5:1 to 40:1, in one aspect 13.5:1 to 40:1, in another aspect 14.5:1 to 40:1, in yet another aspect 15.5:1 to 40:1 and in yet another aspect 16.5:1 to 40:1.

TBN numbers reflect more alkaline products and therefore a greater alkalinity reserve. The TBN of a sample can be determined by ASTM Test No. D2896 or any other equivalent procedure. In general terms, TBN is the neutralization capacity of one gram of the lubricating composition expressed as a number equal to the mg of potassium hydroxide providing the equivalent neutralization. Thus, a TBN of 10 means that one gram of the composition has a neutralization capacity equal to 10 mg of potassium hydroxide. TBN of the actives should be measured.

The term "low overbased" or "LOB" refers to an overbased detergent having a low TBN of the actives of about 0 to about 60.

The term "medium overbased" or "MOB" refers to an overbased detergent having a medium TBN of the actives of greater than about 60 to about 200.

The term "high overbased" or "HOB" refers to an overbased detergent having a high TBN of the actives of greater than about 200 to about 400.

As stated above, the present invention is directed to a lubricating oil composition that comprises at least one carboxylate detergent and at least two phenate detergents that are used in an engine oil.

Lubricating Oil Additive Composition

The lubricating oil additive composition of the present invention comprises at least one carboxylate detergent having a TBN of greater than about 60 to about 200; at least two phenate detergents, wherein a first phenate detergent has a TBN of from about 60 to about 200 and wherein a second phenate detergent has a TBN of from about 200 to about 400; and a polyalkenyl succinimide. Other additives may be employed in the lubricating oil additive composition.

Carboxylate Detergent

In one embodiment, at least one carboxylate detergent, having a TBN of greater than 60 to about 200, is employed in the lubricating oil additive composition.

Typically, the suitable carboxylate detergents are prepared according methods that are well known in the art, including, but not limited to, the processes described in U.S. Patent Publication No. 2007/0105730 and U.S. Patent Publication No. 2007/0027043.

Single-Ring Carboxylate

In one embodiment, the carboxylate detergent that may be used in the lubricating oil additive composition is a single-ring carboxylate having a Total Base Number (TBN) of the actives of greater than about 60 to about 200.

The single carboxylate has the following structure:

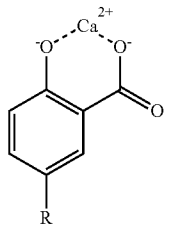

wherein R is a linear hydrocarbyl group, a branched hydrocarbyl group or mixtures thereof. Preferably, R is a linear hydrocarbyl group. More preferably, R is an alkyl group having from 12 to 40 carbon atoms. The single-ring carboxylate is prepared according to the following method.

In the first step, hydrocarbyl phenols are neutralized in the presence of a promoter. In one embodiment, said hydrocarbyl phenols are neutralized using an alkaline earth metal base in the presence of at least one $C_1$ to $C_4$ carboxylic acid. Preferably, this reaction is carried out in the absence of alkali base, and in the absence of dialcohol or monoalcohol.

The hydrocarbyl phenols may contain up to 100% linear hydrocarbyl groups, up to 100% branched hydrocarbyl groups, or both linear and branched hydrocarbyl groups. Preferably, the linear hydrocarbyl group, if present, is alkyl, and the linear alkyl radical contains 12 to 40 carbon atoms, more preferably 18 to 30 carbon atoms. The branched hydrocarbyl radical, if present, is preferably alkyl and contains at least nine carbon atoms, preferably 9 to 24 carbon atoms, more preferably 10 to 15 carbon atoms. In one embodiment, the hydrocarbyl phenols contain up to 85% of linear hydrocarbyl phenol (preferably at least 35% linear hydrocarbyl phenol) in mixture with at least 15% of branched hydrocarbyl phenol.

The use of an alkylphenol containing at least 35% of long-chain linear alkylphenol (from 18 to 30 carbon atoms) is particularly attractive because a long linear alkyl chain promotes the compatibility and solubility of the additives in lubricating oils. However, the presence of relatively heavy linear alkyl radicals in the alkylphenols can make the latter less reactive than branched alkylphenols, hence the need to use harsher reaction conditions to bring about their neutralization by an alkaline earth metal base.

Branched alkylphenols can be obtained by reaction of phenol with a branched olefin, generally originating from propylene. They consist of a mixture of monosubstituted isomers, the great majority of the substituents being in the para position, very few being in the ortho position, and hardly any in the meta position. That makes them relatively more reactive towards an alkaline earth metal base, since the phenol function is practically devoid of steric hindrance.

On the other hand, linear alkylphenols can be obtained by reaction of phenol with a linear olefin, generally originating from ethylene. They consist of a mixture of monosubstituted isomers in which the proportion of linear alkyl substituents in the ortho, para, and metal positions is more uniformly distributed. This makes them less reactive towards an alkaline earth metal base since the phenol function is less accessible due to considerable steric hindrance, due to the presence of closer and generally heavier alkyl substituents. Of course, linear alkylphenols may contain alkyl substituents with some branching which increases the amount of para substituents and, resultantly, increases the relative reactivity towards alkaline earth metal bases.

The alkaline earth metal bases that can be used for carrying out this step include the oxides or hydroxides of calcium, magnesium, barium, or strontium, and particularly of calcium oxide, calcium hydroxide, magnesium oxide, and mixtures thereof. In one embodiment, slaked lime (calcium hydroxide) is preferred.

The promoter used in this step can be any material that enhances neutralization. For example, the promoter may be a polyhydric alcohol, dialcohol, monoalcohol, ethylene glycol or any carboxylic acid. Preferably, a carboxylic acid is used. More preferably, $C_1$ to $C_4$ carboxylic acids are used in this step including, for example, formic, acetic, propionic and butyric acid, and may be used alone or in mixture. Preferably, a mixture of acids is used, most preferably a formic acid/acetic acid mixture. The molar ratio of formic acid/acetic acid should be from 0.2:1 to 100:1, preferably between 0.5:1 and 4:1, and most preferably 1:1. The carboxylic acids act as transfer agents, assisting the transfer of the alkaline earth metal bases from a mineral reagent to an organic reagent.

The neutralization operation is carried out at a temperature of at least 200° C., preferably at least 215° C., and more preferably at least 240° C. The pressure is reduced gradually below atmospheric in order to distill off the water of reaction. Accordingly the neutralization should be conducted in the absence of any solvent that may form an azeotrope with water. Preferably, the pressure is reduced to no more than 7,000 Pa (70 mbars).

The quantities of reagents used should correspond to the following molar ratios: (1) alkaline earth metal base/hydrocarbyl phenol of 0.2:1 to 0.7:1, preferably 0.3:1 to 0.5:1; and (2) carboxylic acid/hydrocarbyl phenol of 0.01:1 to 0.5:1, preferably from 0.03:1 to 0.15:1.

Preferably, at the end of this neutralization step the hydrocarbyl phenate obtained is kept for a period not exceeding fifteen hours at a temperature of at least 215° C. and at an absolute pressure of between 5,000 and 10.sup.5 Pa (between 0.05 and 1.0 bar). More preferably, at the end of this neutralization step the hydrocarbyl phenate obtained is kept for between two and six hours at an absolute pressure of between 10,000 and 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction.

B. Carboxylation Step

The carboxylation step is conducted by simply bubbling carbon dioxide into the reaction medium originating from the preceding neutralization step and is continued until at least 20 mole % of the starting hydrocarbyl phenols is converted to hydrocarbyl salicylate (measured as salicylic acid by potentiometric determination). It must take place under pressure in order to avoid any decarboxylation of the alkylsalicylate that forms.

Preferably, at least 22 mole % of the starting hydrocarbyl phenols is converted to hydrocarbyl salicylate using carbon dioxide at a temperature of between 180° C. and 240° C., under a pressure within the range of from above atmospheric pressure to $15\times10^5$ Pa (15 bars) for a period of one to eight hours.

According to one variant, at least 25 mole % of the starting hydrocarbyl phenols is converted to hydrocarbyl salicylate using carbon dioxide at a temperature equal to or greater than 200° C. under a pressure of $4\times10^5$ Pa (4 bars).

C. Filtration Step

The product of the carboxylation step may advantageously be filtered. The purpose of the filtration step is to remove sediments, and particularly crystalline calcium carbonate, which might have been formed during the preceding steps, and which may cause plugging of filters installed in lubricating oil circuits.

D. Separation Step

At least 10% of the starting hydrocarbyl phenol is separated from the product of the carboxylation step. Preferably, the separation is accomplished using distillation. More preferably, the distillation is carried out in a wiped film evaporator at a temperature of from about 150° C. to about 250° C. and at a pressure of about 0.1 to about 4 mbar; more preferably from about 190° C. to about 230° C. and at about 0.5 to about 3 mbar; most preferably from about 195° C. to about 225° C. and at a pressure of about 1 to about 2 mbar. At least 10% of the starting hydrocarbyl phenol is separated. More preferably, at least 30% of the starting hydrocarbyl phenol is separated. Most preferably, up to 55% of the starting hydrocarbyl phenol is separated. The separated hydrocarbyl phenol may then be recycled to be used as starting materials in the novel process or in any other process.

Unsulfurized, Carboxylate-Containing Additive

The unsulfurized, carboxylate-containing additive formed by the present process can be characterized by its unique composition, with much more alkaline earth metal single-aromatic-ring hydrocarbyl salicylate and less hydrocarbyl phenol than produced by other routes. When the hydrocarbyl group is an alkyl group, the unsulfurized, carboxylate-containing additive has the following composition; (a) less than 40% alkylphenol, (b) from 10% to 50% alkaline earth metal alkylphenate, and (b) from 15% to 60% alkaline earth metal single-aromatic-ring alkylsalicylate.

Unlike alkaline earth metal alkylsalicylates produced by other process, this unsulfurized, carboxylate-containing additive composition can be characterized by having only minor amounts of an alkaline earth metal double-aromatic-ring alkylsalicylates. The mole ratio of single-aromatic-ring alkylsalicylate to double-aromatic-ring alkylsalicylate is at least 8:1.

Characterization of the Product by Infrared Spectrometry

Out-of-aromatic-ring-plane C—H bending vibrations were used to characterize the unsulfurized carboxylate-containing additive of the present invention. Infrared spectra of aromatic rings show strong out-of-plane C—H bending transmittance band in the 675-870 $cm^{-1}$ region, the exact frequency depending upon the number and location of substituents. For ortho-disubstituted compounds, transmittance band occurs at 735-770 $cm^{-1}$. For para-disubstituted compounds, transmittance band occurs at 810-840 $cm^{-1}$.

Infrared spectra of reference chemical structures relevant to the present invention indicate that the out-of-plane C—H bending transmittance band occurs at 750±3 $cm^{-1}$ for ortho-alkylphenols, at 760±2 $cm^{-1}$ for salicylic acid, and at 832±3 $cm^{-1}$ for para-alkylphenols.

Alkaline earth alkylphenates known in the art have infrared out-of-plane C—H bending transmittance bands at 750±3 $cm^{-1}$ and at 832±3 $cm^{-1}$. Alkaline earth alkylsalicylates known in the art have infrared out-of-plane C—H bending transmittance bands at 763±3 $cm^{-1}$ and at 832±3 $cm^{-1}$.

The unsulfurized carboxylate-containing additive of the present invention shows essentially no out-of-plane C—H bending vibration at 763±3 $cm^{-1}$, even though there is other evidence that alkylsalicylate is present. This particular characteristic has not been fully explained. However, it may be hypothesized that the particular structure of the single aromatic ring alkylsalicylate prevents in some way this out-of-plane C—H bending vibration. In this structure, the carboxylic acid function is engaged in a cyclic structure, and thus may generate increased steric hindrance in the vicinity of the aromatic ring, limiting the free motion of the neighbor hydrogen atom. This hypothesis is supported by the fact that the infrared spectrum of the acidified product (in which the carboxylic acid function is no longer engaged in a cyclic structure and thus can rotate) has an out-of-plane C—H transmittance band at 763±3 $cm^{-1}$.

The unsulfurized carboxylate-containing additive of the present invention can thus be characterized by having a ratio of infrared transmittance band of out-of-plane C—H bending at about 763±3 $cm^{-1}$ to out-of-plane C—H bending at 832±3 $cm^{-1}$ of less than 0.1:1.

The unsulfurized, carboxylate-containing additive formed by this method, being non-sulfurized, would provide improved high temperature deposit control performance over sulfurized products. Being alkali-metal free, this additive can be employed as a detergent-dispersant in applications, such as marine engine oils, where the presence of alkali metals have proven to have harmful effects.

Additional Carboxylate Additives

Other carboxylate additives may be used in the lubricating oil additive composition of the present invention are prepared according the following process.

The overbased alkaline earth metal alkylhydroxybenzoate (i.e., carboxylate) of the present invention will typically have a structure as shown below as Formula (I).

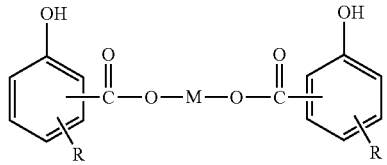

wherein R is a linear aliphatic group, branched aliphatic group or a mixture of linear and branched aliphatic groups. Preferably, R is an alkyl or alkenyl group. More preferably, R is an alkyl group.

M is an alkaline earth metal selected of the group consisting of calcium, barium, magnesium, strontium. Calcium and magnesium are the preferred alkaline earth metal. Calcium is more preferred.

When R is a linear aliphatic group, the linear alkyl group typically comprises from about 12 to 40 carbon atoms, more preferably from about 18 to 30 carbon atoms.

When R is a branched aliphatic group, the branched alkyl group typically comprises at least 9 carbon atoms, preferably from about 9 to 40 carbon atoms, more preferably from about 9 to 24 carbon atoms and most preferably from about 10 to 18 carbon atoms. Such branched aliphatic groups are preferably derived from an oligomer of propylene or butene.

R can also represent a mixture of linear or branched aliphatic groups. Preferably, R represents a mixture of linear alkyl containing from about 20 to 30 carbon atoms and branched alkyl containing about 12 carbon atoms.

When R represents a mixture of aliphatic groups, the alkaline-earth metal alkylhydroxybenzoic acid employed in the present invention may contain a mixture of linear groups, a mixture of branched groups, or a mixture of linear and branched groups. Thus, R can be a mixture of linear aliphatic groups, preferably alkyl; for example, an alkyl group selected from the group consisting of $C_{14}$-$C_{16}$, $C_{16}$-$C_{18}$, $C_{18}$-$C_{20}$, $C_{20}$-

$C_{22}$, $C_{20}$-$C_{24}$ and $C_{20}$-$C_{28}$ alkyl and mixtures thereof and derived from normal alpha olefins. Advantageously, these mixtures include at least 95 mole %, preferably 98 mole % of alkyl groups and originating from the polymerization of ethylene.

The alkaline earth metal alkylhydroxybenzoates of the present invention wherein R represents a mixture of alkyl groups, can be prepared from linear alpha olefin cuts, such as those marketed by Chevron Phillips Chemical Company under the names Normal Alpha Olefin $C_{26}$-$C_{28}$ or Normal Alpha Olefin $C_{20}$-$C_{24}$, by British Petroleum under the name $C_{20}$-$C_{26}$ Olefin, by Shell Chimie under the name SHOP C20-C22, or mixtures of these cuts or olefins from these companies having from about 20 to 28 carbon atoms.

The —COOM group of Formula (I) can be in the ortho, meta or para position with respect to the hydroxyl group.

The alkaline earth metal alkylhydroxybenzoates of the present invention can be any mixture of alkaline-earth metal alkylhydroxybenzoic acid having the —COOM group in the ortho, meta or para position.

The alkaline earth metal alkylhydroxybenzoates of the present invention are generally soluble in oil as characterized by the following test.

A mixture of a 600 Neutral diluent oil and the alkylhydroxybenzoate at a content of 10 wt % with respect to the total weight of the mixture is centrifuged at a temperature of 60° C. and for 30 minutes, the centrifugation being carried out under the conditions stipulated by the standard ASTM D2273 (it should be noted that centrifugation is carried out without dilution, i.e. without adding solvent); immediately after centrifugation, the volume of the deposit which forms is determined; if the deposit is less than 0.05% v/v (volume of the deposit with respect to the volume of the mixture), the product is considered as soluble in oil.

Advantageously, the TBN of the high overbased alkaline earth metal alkylhydroxybenzoate of the present invention is greater than 250, preferably from about 250 to 450 and more preferably from about 300 to 400 and will generally have less than 3 volume %, preferably less than 2 volume % and more preferably less than 1 volume % crude sediment. For the middle overbased alkaline earth metal alkylhydroxybenzoate of the present invention, the TBN is from about 100 to 250, preferably from about 140 to 230 and will generally have less than 1 volume %, preferably less than 0.5 volume % crude sediment.

Process

In the first embodiment of the present invention, the process for preparing the overbased alkaline earth metal alkylhydroxybenzoate involves overbasing the alkaline earth metal alkylhydroxylbenzoate or a mixture of alkaline earth metal alkylhydroxylbenzoate and up to 50 mole % of alkylphenol, based on the total mixture of alkylhydroxybenzoate and alkylphenol, with a molar excess of alkaline earth metal base and at least one acidic overbasing material in presence of at least one carboxylic acid having from one to four carbon atoms and a solvent selected form the group consisting of aromatic hydrocarbons, aliphatic hydrocarbons, monoalcohols, and mixtures thereof.

Overbasing of the alkaline earth metal alkylhydroxybenzoate or mixture of alkaline earth metal alkylhydroxybenzoate and alkylphenol may be carried out by any method known by a person skilled in the art to produce overbased alkaline earth metal alkylhydroxybenzoates. However, it has been surprisingly discovered that the addition of a small quantity of $C_1$-$C_4$ carboxylic acid at this step decreases the crude sediment obtained at the end of overbasing step by a factor of at least 3.

The $C_1$-$C_4$ carboxylic acids used in the neutralization step include formic acid, acetic acid, propionic acid, and butyric acid, which may be used alone or in mixture. It is preferable to use mixtures of such acids as, for example, formic acid: acetic acid, in a molar ratio of formic acid:acetic acid of from about 0.1:1 to 100:1, preferably from about 0.5:1 to 4:1, more preferably from about 0.5:1 to 2:1, and most preferably about 1:1.

Generally, the overbasing reaction is carried out in a reactor in the presence of alkylhydroxybenzoic acid from about 10 wt % to 70 wt %, alkylphenol from about 1 wt % to 30 wt %, diluent oil from about 0 wt % to 40 wt %, an aromatic solvent from about 20 wt % to 60 wt %. The reaction mixture is agitated. The alkaline earth metal associated with an aromatic solvent, a monoalcohol and carbon dioxide are added to the reaction while maintaining the temperature between about 20° C. and 80° C.

The degree of overbasing may be controlled by the quantity of the alkaline earth metal, carbon dioxide and the reactants added to the reaction mixture and the reaction conditions used during the carbonation process.

The weight ratios of reagents used (methanol, xylene, slaked lime and $CO_2$) will correspond to the following weight ratios: Xylene:slaked lime from about 1.5:1 to 7:1, preferably from about 2:1 to 4:1. Methanol:slaked lime from about 0.25:1 to 4:1, preferably from about 0.4:1 to 1.2:1. Carbon dioxide:slaked lime from a molar ratio about 0.5:1 to 1.3:1, preferably from about 0.7:1 to 1.0:1. $C_1$-$C_4$ carboxylic acid: alkylhydroxybenzoic acid a molar ratio from about 0.02:1 to 1.5:1, preferably from about 0.1:1 to 0.7:1.

Lime is added as a slurry. i.e., as a pre-mixture of lime, methanol, xylene, and CO.sub.2 is introduced over a period of 1 hour to 4 hours, at a temperature between about 20° C. and 65° C.

The quantity of lime and CO.sub.2 are adjusted in order to obtain a high overbased material (TBN>250) and crude sediment in the range of 0.4 to 3 volume %, preferably in the range of 0.6 to 1.8 volume %, without any deterioration of the performance. With the omission of $C_1$-$C_4$ carboxylic acid, it is not able to reach this low level of crude sediment. Typically, crude sediment without a $C_1$-$C_4$ carboxylic acid will range from about 4 to 8 volume %.

For a middle overbased material (TBN from about 100 to 250), the quantity of lime and $CO_2$ are adjusted in order to obtain a crude sediment in the range of 0.2 to 1 volume %. The crude sediment without the use of $C_1$-$C_4$ carboxylic acid will range from about 0.8 to 3 volume %.

In a second embodiment of the present invention, the overbased alkaline earth metal alkylhydroxybenzoate may be prepared by the following steps:

A. Formation of the Alkali Metal Base Alkylphenate:

In the first step, alkylphenols are neutralized using an alkali metal base preferably in the presence of a light solvent, such as toluene, xylene isomers, light alkylbenzene or the like, to form the alkali metal base alkylphenate. In one embodiment, the solvent forms an azeotrope with water. In another embodiment, the solvent may also be a mono-alcohol such as 2-ethylhexanol. In this case, the 2-ethylhexanol is eliminated by distillation before carboxylation. The objective with the solvent is to facilitate the elimination of water.

The hydrocarbyl phenols may contain up to 100 wt % linear hydrocarbyl groups, up to 100 wt % branched hydrocarbyl groups, or both linear and branched hydrocarbyl groups. Preferably, the linear hydrocarbyl group, if present, is alkyl, and the linear alkyl group contains from about 12 to 40 carbon atoms, more preferably from about 18 to 30 carbon atoms. The branched hydrocarbyl group, if present, is preferably alkyl and contains at least 9 carbon atoms, preferably from about 9 to 40 carbon atoms, more preferably from about 9 to 24 carbon atoms and most preferably from about 10 to 18 carbon atoms. In one embodiment, the hydrocarbyl phenols contain up to 85 wt % of linear hydrocarbyl phenol (preferably at least 35 wt % linear hydrocarbyl phenol) in mixture with at least 15 wt % of branched hydrocarbyl phenol. In one embodiment, the hydrocarbyl phenols are 100% linear alkylphenols.

The use of an alkylphenol containing up to at least 35 wt % of long linear alkylphenol (from about 18 to 30 carbon atoms) is particularly attractive because a long linear alkyl chain promotes the compatibility and solubility of the additives in lubricating oils.

Branched alkylphenols can be obtained by reaction of phenol with a branched olefin, generally originating from propylene.

They consist of a mixture of monosubstituted isomers, the great majority of the substituents being in the para position, very few being in the ortho position, and hardly any in the meta position.

On the other hand, linear alkylphenols can be obtained by reaction of phenol with a linear olefin, generally originating from ethylene. They consist of a mixture of monosubstituted isomers in which the proportion of linear alkyl substituents in the ortho, meta, and para positions is much more uniformly distributed. Of course, linear alkylphenols may contain alkyl substituents with some branching which increases the amount of para substituents and, resultantly may increase the relative reactivity towards alkali metal bases.

The alkali metal bases that can be used for carrying out this step include the oxides or hydroxides of lithium, sodium or potassium. In a preferred embodiment, potassium hydroxide is preferred. In another preferred embodiment, sodium hydroxide is preferred.

An objective of this step is to have an alkylphenate having less than 2000 ppm, preferably less than 1000 ppm and more preferably less than 500 ppm of water.

In this regard, the first step is carried out at a temperature high enough to eliminate water. In one embodiment, the product is put under a slight vacuum in order to require a lower reaction temperature.

In one embodiment, xylene is used as a solvent and the reaction conducted at a temperature between 130° C. and 155° C., under an absolute pressure of 800 mbar ($8\times10^4$ Pa).

In another embodiment, 2-ethylhexanol is used as solvent. As the boiling point of 2-ethylhexanol (184° C.) is significantly higher than xylene (140° C.), the reaction is conducted at a temperature of at least 150° C.

The pressure is reduced gradually below atmospheric in order to complete the distillation of water reaction. Preferably, the pressure is reduced to no more than 70 mbar ($7\times10^3$ Pa).

By providing that operations are carried out at a sufficiently high temperature and that the pressure in the reactor is reduced gradually below atmospheric, the formation of the alkali metal base alkylphenate is carried out without the need to add a solvent and forms an azeotrope with the water formed during this reaction. For instance, temperature is heated up to 200° C. and then the pressure is reduced gradually below atmospheric. Preferably the pressure is reduced to no more than 70 mbar ($7\times10^3$ Pa).

Elimination of water is done over a period of at least 1 hour, preferably at least 3 hours.

The quantities of reagents used should correspond to the following molar ratios: alkali metal base:alkylphenol from about 0.5:1 to 1.2:1, preferably from about: 0.9:1 to 1.05:1 solvent:alkylphenol (wt:wt) from about 0.1:1 to 5:1, preferably from about 0.3:1 to 3:1

B. Carboxylation:

This carboxylation step is conducted by simply bubbling carbon dioxide ($CO_2$) into the reaction medium originating from the preceding neutralization step and is continued until at least 50 mole % of the starting alkylphenol has been converted to alkylhydroxybenzoic acid (measured as hydroxybenzoic acid by potentiometric determination).

At least 50 mole %, preferably 75 mole %, and more preferably 85 mole %, of the starting alkylphenol is converted to alkylhydroxylbenzoate using carbon dioxide at a temperature between about 110° C. and 200° C. under a pressure within the range of from about atmospheric to 15 bar ($15\times10^5$ Pa), preferably from 1 bar ($1\times10^5$ Pa) to 5 bar ($5\times10^5$ Pa), for a period between about 1 and 8 hours.

In one variant with potassium salt, temperature is preferably between about 125° C. and 165° C. and more preferably between 130° C. and 155° C., and the pressure is from about atmospheric to 15 bar ($15\times10^5$ Pa), preferably from about atmospheric to 4 bar ($4\times10^5$ Pa).

In another variant with sodium salt, temperature is directionally lower preferably between from about 110° C. and 155° C. More preferably from about 120° C. and 140° C. and the pressure from about 1 bar to 20 bar ($1\times10^5$ to $20\times10^5$ Pa), preferably from 3 bar to 15 bar ($3\times10^5$ to $15\times10^5$ Pa).

The carboxylation is usually carried out, diluted in a solvent such as hydrocarbons or alkylate, e.g., benzene, toluene, xylene and the like. In this case, the weight ratio of solvent: hydroxybenzoate is from about 0.1:1 to 5:1, preferably from about 0.3:1 to 3:1.

In another variant, no solvent is used. In this case, carboxylation is conducted in the presence of diluent oil in order to avoid a too viscous material.

The weight ratio of diluent oil:alkylhydroxybenzoate is form about 0.1:1 to 2:1, preferably from about 0.2:1 to 1:1, and more preferably from about 0.2:1 to 0.5:1.

C. Acidification:

The objective of this step is to acidify the alkylhydroxybenzoate salt diluted in the solvent to give an alkylhydroxybenzoic acid. Any acid stronger than alkylhydroxybenzoic acid could be utilized. Usually hydrochloric acid or aqueous sulfuric acid is utilized.

Acidification step is conducted with an H.sup.+ equivalent excess of acid versus potassium hydroxide of at least 5 H+ equivalent %, preferably 10 H+ equivalent % and more preferably 20 H+ equivalent %, the acidification is complete.

In one embodiment, sulfuric acid is used. It is diluted to about 5 volume % to 50 volume %, preferably 10 volume % to 30 volume %. The quantity of sulfuric acid used versus hydroxybenzoate (salicylate), on a per mole of hydroxybenzoate basis, is at least 0.525 mole, preferably 0.55 mole and more preferably 0.6 mole of sulfuric acid.

The acidification reaction is carried out under agitation or with any suitable mixing system at a temperature from about room temperature to 95° C., preferably from about 50° C. to 70° C., over a period linked with the efficiency of the mixing. For example, when a stirred reactor is utilized and the period is from about 15 minutes to 300 minutes, preferably from about 60 minutes to 180 minutes. When a static mixer is utilized, the period may be shorter.

At the end of this period time, the agitation is stopped in order to allow good phase separation before the aqueous phase was separated. After phase separation is complete, the organic phase is then neutralized, overbased, centrifugated to eliminate impurities and distilled to eliminate solvent. The water phase is treated as a waste material. In one embodiment, the organic phase is sent through a coalescer to decrease the level of residual water and water-soluble impurities such as sulfuric acid and potassium sulfate as a consequence.

D. Contact with Carboxylic Acid:

The alkylhydroxybenzoic acid in step C is contacted with at least one carboxylic acid having from about one to four carbon atoms.

E. Neutralization:

The mixture of alkylhydroxybenzoic acid and the at least one carboxylic acid from step D is neutralized with an alkaline earth metal base and at least one solvent selected from the group consisting of aromatic hydrocarbons, aliphatic hydrocarbons monoalcohols, and mixtures thereof to form an alkaline earth metal alkylhydroxylbenzoate and at least one alkaline earth metal carboxylic acid salt.

F. Overbasing:

Overbasing of the mixture of alkylhydroxybenzoic acid and alkylphenol may be carried out by any method known by a person skilled in the art to produce alkylhydroxybenzoates. However, it has been surprisingly discovered that the addition of a small quantity of $C_1$-$C_4$ carboxylic acid at this step decreases the crude sediment obtained at the end of overbasing step by a factor of at least 3.

The $C_1$-$C_4$ carboxylic acids used in the neutralization step include formic acid, acetic acid, propionic acid, and butyric acid, which may be used alone or in mixture. It is preferable to use mixtures of such acids as, for example, formic acid: acetic acid, in a molar ratio of formic acid:acetic acid of from about 0.1:1 to 100:1, preferably from about 0.5:1 to 4:1, and more preferably from about 0.5:1 to 2:1.

Generally, the overbasing reaction is carried out in a reactor in the presence of alkylhydroxybenzoic acid from about 10 wt % to 70 wt %, alkylphenol from about 1 wt % to 30 wt %, diluent oil from about 0 wt % to 40 wt %, an aromatic solvent from about 20 wt % to 60 wt %. The reaction mixture is agitated. The alkaline earth metal associated with an aromatic solvent, a monoalcohol and carbon dioxide are added to the reaction while maintaining the temperature between about 20° C. and 80° C.

The degree of overbasing may be controlled by the quantity of the alkaline earth metal, carbon dioxide and the reactants added to the reaction mixture and the reaction conditions used during the carbonation process.

The weight ratios of reagents used (methanol, xylene, slaked. lime and $CO_2$) will correspond to the following weight ratios: Xylene:slaked lime from about 1.5:1 to 7:1, preferably from about 2:1 to 4:1. Methanol:slaked lime from about 0.25:1 to 4:1, preferably from about 0.4:1 to 1.2:1. Carbon dioxide:slaked lime from a molar ratio about 0.5:1 to 1.3:1, preferably from about 0.7:1 to 1.0:1. C.sub.1-$C_4$ carboxylic acid:alkylhydroxybenzoic acid a molar ratio from about 0.02:1 to 1.5:1, preferably from about 0.1:1 to 0.7:1.

Lime is added as a slurry, i.e., as a pre-mixture of lime, methanol, xylene, and $CO_2$ is introduced over a period of 1 hour to 4 hours, at a temperature between about 20° C. and 65° C.

The quantity of lime and $CO_2$ are adjusted in order to obtain a high overbased material (TBN>250) and crude sediment in the range of 0.4 to 3 volume %, preferably in the range of 0.6 to 1.8 volume %, without any deterioration of the performance. With the omission of $C_1$-$C_4$ carboxylic acid, it is not able to reach this low level of crude sediment. Typically, crude sediment without a $C_1$-$C_4$ carboxylic acid will range from about 4 to 8 volume %.

For a middle overbased material (TBN from about 100 to 250), the quantity of lime and $CO_2$ are adjusted in order to obtain a crude sediment in the range of 0.2 to 1 volume %. The crude sediment without the use of $C_1$-$C_4$ carboxylic acid will range from about 0.8 to 3 volume %.

In the third embodiment of the present invention, the overbased alkaline earth metal alkylhydroxybenzoate may be obtained by a process having steps A through C above followed by:

D. Neutralization:

The mixture of alkylhydroxybenzoic acid from step C is neutralized with a molar excess of an alkaline earth metal base and at least one solvent selected from the group consisting of aromatic hydrocarbons, aliphatic hydrocarbons, monoalcohols, and mixtures thereof to form an alkaline earth metal alkylhydroxybenzoate.

E. Contact with Carboxylic Acid:

The alkaline earth metal alkylhydroxybenzoate and alkaline earth metal base formed in step D is contacted with at least one carboxylic acid having from about one to four carbon atoms to form a mixture of alkaline earth metal alkylhydroxybenzoate and at least one alkaline earth metal carboxylate.

F. Overbasing:

The alkaline earth metal alkylhydroxybenzoate is then overbased according to the description provided above.

Optionally, predistillation, centrifugation and distillation may also be utilized to remove solvent and crude sediment. Water, methanol and a portion of the xylene may be eliminated by heating between about 110° C. to 134° C. This may be followed by centrifugation to eliminated unreacted lime. Finally, xylene may be eliminated by heating under vacuum in order to reach a flash point of at least about 160° C. as determined with the Pensky-Martens Closed Cup (PMCC) Tester described in ASTM D93.

Phenate Detergent

In one embodiment of the present invention, the lubricating oil additive composition comprises at least two phenate detergents. A first phenate detergent is a medium overbased detergent having a TBN of the actives of greater than about 60 to about 200. A second phenate detergent is a high overbased detergent having a TBN of the actives of greater than about 200 to about 400.

Typically, the phenate may be prepared according to the processes that are described in U.S. Pat. No. 3,801,507, which is herein incorporated by reference and in U.S. Pat. No. 5,677,270 which is herein incorporated by reference.

The present process can be conveniently conducted by contacting the desired alkylphenol with sulfur in the presence of a lower alkanoic acid and metal base under reactive conditions, preferably in an inert-compatible liquid hydrocarbon diluent. Preferably the reaction is conducted under an inert gas, typically nitrogen. In theory the neutralization can be conducted as a separate step prior to sulfurization, but pragmatically it is generally more convenient to conduct the sulfurization and the neutralization together in a single process step. Also, in place of the lower alkanoic acid, salts of the alkanoic acids or mixtures of the acids and salts could also be used. Where salts or mixtures of salts and acids are used, the salt is preferably an alkaline earth metal salt and most preferably a calcium salt. However, in general the acids are preferred and accordingly the process will be described below with respect to the use of lower alkanoic acid; however, it should be appreciated that the teachings are also applicable to the use of salts and mixtures of salts in place of all or a portion of the acids.

The combined neutralization and sulfurization reaction is typically conducted at temperatures in the range of about from 115° C. to 300° C., preferably 135° C. to 230° C.

depending on the particular metal and alkanoic acid used. Where formic acid is used alone, we have found that best results are generally obtained by using temperatures in the range of about from 150° C. to 200° C. By using formic acid with other alkanoic acids (acetic, propionic, or acetic/propionic), one can advantageously use the higher reaction temperatures and obtain higher base retention and reduced piston deposits. For example, with these mixtures, one can use temperatures in the range of about from 180° C. to 250° C. and especially at temperatures of about from 200° C. to 235° C. Mixtures of two or all three of the lower alkanoic acids also can be used. Mixtures containing about from 5 to 25 wt % formic acid and about from 75 to 95 wt % acetic acid are especially advantageous where normal or moderately overbased products are desired. Based on one mole of alkylphenol, typically from 0.8 to 3.5, preferably from 1.2 to 2, moles of sulfur and about 0.025 to 2, preferably 0.1 to 0.8, moles of lower alkanoic acid are used. Typically about 0.3 to 1 mole, preferably 0.5 to 0.8 mole, of metal base are employed per mole of alkylphenol. In addition an amount of metal base sufficient to neutralize the lower alkanoic acid is also used. Thus overall, typically about from 0.3 to 2 moles of metal base are used per mole of alkylphenol, including the base required to neutralize the lower alkanoic acid. If preferred, lower alkanoic acid to alkylphenol and metal base to alkylphenol ratios are used, then the total metal base to alkylphenol ratio range will be about from 0.55 to 1.2 moles of metal base per mole of alkylphenol. Obviously, this additional metal base will not be required where salts of alkanoic acids are used in place of the acids. The reaction is also typically and preferably conducted in a compatible liquid diluent, preferably a low viscosity mineral or synthetic oil. The reaction is preferably conducted for a sufficient length of time to ensure complete reaction of the sulfur. This is especially important where high TBN products are desired because the synthesis of such products generally requires using carbon dioxide together with a polyol promoter. Accordingly, any unreacted sulfur remaining in the reaction mixture will catalyze the formation of deleterious oxidation products of the polyol promoter during the overbasing step.

Where the neutralization is conducted as a separate step, both the neutralization and the subsequent sulfurization are conducted under the same conditions as set forth above. Optionally specialized sulfurization catalysts, such as described in U.S. Pat. No. 4,744,921, the disclosure of which is hereby incorporated in its entirety, can be employed in the neutralization-sulfurization reaction together with the lower alkanoic acid. But, in general any benefit afforded by the sulfurization catalyst, for example, reduced reaction time, is offset by the increase in costs incurred by the catalyst and/or the presence of undesired residues in the case of halide catalysts or alkali metal sulfides; especially, as excellent reaction rates can be obtained by merely using acetic and/or propionic acid mixtures with formic acid and increasing reaction temperatures.

In one embodiment, the sulfurization process is conducted in the presence of water throughout the process. This results in lower crude sediments (more efficient filtration), less haze, and improved water stability.

Preferably, at least 50 wt % of the promoter is added to the reaction at a temperature of at least 130° C. This results in more efficient filtration.

If a high TBN product is desired, the sulfurized phenate product can be overbased by carbonation. Such carbonation can be conveniently effected by addition of a polyol promoter, typically an alkylene diol, e.g., ethylene glycol, and carbon dioxide to the sulfurized phenate reaction product. Additional metal base can be added at this time and/or excess metal base can be used in the neutralization step. Preferably, an alkenyl succinimide or a neutral or overbased Group II metal hydrocarbylsulfonate is added to either the neutralization-sulfurization reaction mixture or overbasing reaction mixture. The succinimide or sulfonate assists in solubilizing both the alkylphenol and the phenate reaction product and therefore, when used, is preferably added to the initial reaction mixture. Overbasing is typically conducted at temperatures in the range of above from 160° C. to 190° C., preferably 170° C. to 180° C., for about from 0.1 to 4 hours, depending on whether a moderate or high TBN product is desired. Conveniently, the reaction is conducted by the simple expedient of bubbling gaseous carbon dioxide through the reaction mixture. Excess diluent and any water formed during the overbasing reaction can be conveniently removed by distillation either during or after the reaction.

Carbon dioxide is employed in the reaction system in conjunction with the metal base to form overbased products and is typically employed at a ratio of about from 1 to 3 moles per mole of alkylphenol, and preferably from about 2 to about 3 moles per mole of alkylphenol. Preferably, the amount of $CO_2$ incorporated into the overbased sulfurized alkylphenate provides for a $CO_2$ to metal weight ratio of about from 0.65:1 to about 0.73:1. All of the metal base including the excess used for overbasing may be added in the neutralization or a portion of the Group II base can be added prior to carbonation.

Where a moderate TBN product (a TBN of about 150 to 225) is desired, a stoichiometric amount or slight excess of metal base can be used in the neutralization step; for example, about from 0.5 to 1.3 moles of base per mole of alkylphenol in addition to the amount needed to neutralize the lower alkanoic acid. High TBN products are typically prepared by using a mole ratio of metal base to alkylphenol of about 1 to 2.5, preferably about 1.5 to 2, a carbon dioxide mole ratio of about 0.2 to 2, preferably 0.4 to 1, moles of carbon dioxide per mole of alkylphenol and about 0.2 to 2, preferably 0.4 to 1.2, moles of alkylene glycol. Again where lower alkanoic acids are used, in contrast to their salts, an additional amount of metal base sufficient to neutralize the lower alkanoic acid should be used. As noted above all of the excess metal base needed to produce a high TBN product can be added in the neutralization-sulfurization step or the excess above that needed to neutralize the alkylphenol can be added in the overbasing step or divided in any proportion between the two steps. Typically where very high TBN products are desired a portion of the metal base will be added in the overbasing step. The neutralization reaction mixture or overbasing reaction mixture preferably also contains about from 1 to 20, preferably 5 to 15, weight percent of a neutral or overbased sulfonate and/or an alkenyl succinimide based on the weight of alkylphenol. (In general where high TBN are desired, TBN in the range of about from 250 to 300 are preferred.)

Typically, the process is conducted under vacuum up to a slight pressure, i.e., pressures ranging from about 25 mm Hg absolute to 850 mm Hg absolute and preferably is conducted under vacuum to reduce foaming up to atmospheric pressure, e.g., about from 40 mm Hg absolute to 760 mm Hg absolute.

Additional details regarding the general preparation of sulfurized phenates can be had by reference to the various publications and patents in this technology such as, for example, U.S. Pat. Nos. 2,680,096; 3,178,368 and 3,801,507. The relevant disclosures and these patents are hereby incorporated by reference in their entirety.

Considering now in detail, the reactants and reagents used in the present process, first all allotropic forms of sulfur can be used. The sulfur can be employed either as molten sulfur or as a solid (e.g., powder or particulate) or as a solid suspension in a compatible hydrocarbon liquid.

Preferably, the metal base used is calcium hydroxide because of its handling convenience versus, for example, calcium oxide, and also because it affords excellent results. Other calcium bases can also be used, for example, calcium alkoxides.

In one embodiment, a mixture of metal bases is used. For instance, a substantially calcium containing phenate is prepared with exactly enough lithium base to neutralize the alkanoic promoter.

In another embodiment, the metal base used is lithium hydroxide because it affords excellent results. Other lithium bases can also be used, for example, lithium alkoxides.

Suitable alkylphenols which can be used in this invention are those wherein the alkyl substituents contain a sufficient number of carbon atoms to render the resulting overbased sulfurized alkylphenate composition oil-soluble. Oil solubility may be provided by a single long chain alkyl substituent or by a combination of alkyl substituents. Typically the alkylphenol used in the present process will be a mixture of different alkylphenols, e.g., $C_1$-$C_{24}$ alkylphenol. Where phenate products having a TBN of 275 or less are desired, it is economically advantageous to use 100% polypropenyl substituted phenol because of its commercial availability and generally lower costs. Where higher TBN phenate products are desired, preferably about 25 to 100 mole percent of the alkylphenol will have straight-chain alkyl substituent of from 15 to 35 carbon atoms and from about 75 to 0 mole percent in which the alkyl group is polypropenyl of from 9 to 18 carbon atoms. More preferably, in about 35 to 100 mole percent of the alkylphenol the alkyl group will be a straight-chain alkyl of about 15 to 35 carbon atoms and in about from 65 to 0 mole percent of the alkylphenol, the alkyl group will be polypropenyl of from 9 to 18 carbon atoms. The use of an increasing amount of predominantly straight chain alkylphenols results in high TBN products generally characterized by lower viscosities. On the other hand, while polypropenylphenols are generally more economical than predominantly straight chain alkylphenols, the use of greater than 75 mole percent polypropenylphenol in the preparation of overbased sulfurized alkylphenate compositions generally results in products of undesirably high viscosities. However, use of a mixture of from 75 mole percent or less of polypropenylphenol of from 9 to 18 carbon atoms and from 25 mole percent or more of predominantly straight chain alkylphenol of from 15 to 35 carbon atoms allows for more economical products of acceptable viscosities.

Preferably, the alkylphenols are para-alkylphenols or ortho-alkylphenols. Since it is believed that para-alkylphenols facilitate the preparation of highly overbased sulfurized alkylphenate where overbased products are desired, the alkylphenol is preferably predominantly a para-alkylphenol with no more than about 45 mole percent of the alkylphenol being ortho-alkylphenols; and more preferably no more than about 35 mole percent of the alkylphenol is ortho-alkylphenol. Alkyl-hydroxy toluenes or xylenes, and other alkyl phenols having one or more alkyl substituents in addition to at least one long chained alkyl substituent can also be used.

In general the present process introduces no new factor or criteria for the selection of alkylphenols and accordingly the selection of alkylphenols can be based on the properties desired for lubricating oil compositions, notably TBN and oil solubility, and the criteria used in the prior art or similar sulfurization overbasing process and/or processes. For example, in the case of alkylphenate having substantially straight chain alkyl substituents, the viscosity of the alkylphenate composition can be influenced by the position of an attachment on alkyl chain to the phenyl ring, e.g., end attachment versus middle attachment. Additional information regarding this and the selection and preparation of suitable alkylphenols can be had for example from U.S. Pat. Nos. 5,024,773, 5,320,763; 5,318,710; and 5,320,762, all of which are hereby incorporated by reference in their entirety.

If a supplemental sulfurization catalyst, such as for example desired in U.S. Pat. No. 4,744,921, is employed, it is typically employed at from about 0.5 to 10 wt % relative to the alkylphenol, and preferably at from about 1 to 2 wt %. In a preferred embodiment, the sulfurization catalyst is added to the reaction mixture as a liquid. This can be accomplished by dissolving the sulfurization catalyst in molten sulfur or in the alkylphenol as a premix to the reaction.

The overbasing procedure used to prepare the high TBN overbased sulfurized alkylphenate compositions of this invention also employs a polyol promoter, typically a $C_2$ to $C_4$ alkylene glycol, preferably ethylene glycol, in the overbasing step.

Suitable Group II metal neutral or overbased hydrocarbyl sulfonates include natural or synthetic hydrocarbyl sulfonates such as petroleum sulfonate, synthetically alkylated aromatic sulfonates, or aliphatic sulfonates such as those derived from polyisobutylene. These sulfonates are well-known in the art. (Unlike phenates, "normal" sulfonates are neutral and hence are referred to as neutral sulfonates.) The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates that are aromatic in character. Such sulfonates are conventionally used to facilitate the overbasing by keeping the calcium base in solutions.

Sulfonates suitable for use in the present process are typically prepared by sulfonating a petroleum fraction having aromatic groups, usually mono- or dialkylbenzene groups, and then forming the metal salt of the sulfonic acid material. The sulfonates can optionally be overbased to yield products having Total Base Numbers up to about 400 or more by addition of an excess of a Group II metal hydroxide or oxide and optionally carbon dioxide. Calcium hydroxide or oxide is the most commonly used material to produce the basic overbased sulfonates.

When employed, the Group II metal neutral or overbased hydrocarbyl sulfonate is employed at from about 1 to 20 wt % relative to the alkylphenol, preferably from about 1 to 10 wt %. Where the product is intended as an additive for marine crankcase lubricated oil formulations the use of Group II metal neutral or overbased hydrocarbyl sulfonate described above is especially attractive because sulfonates are advantageously employed in such formulations in conjunction with the overbased sulfurized alkylphenates.

Alternatively, in lieu of a Group II metal neutral or overbased hydrocarbyl or in combination therewith, an alkenyl succinimide may be employed. Alkenyl succinimides are well-known in the art. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082; 3,219,666; and 3,172,892, the disclosure of which are incorporated herein by reference. Alkyl succinimides are intended to be included within the scope of the term "alkenyl succinimide." The alkenyl group of the alkenyl succinic anhydride is derived from an alkene, preferably polyisobutene, and is obtained by polymerizing an alkene (e.g., isobutene) to provide for a polyalkene which can vary widely in its compositions. The average number of carbon atoms in the polyalkene and hence the alkenyl substituent of the succinic anhydride can range from 30 or less to 250 or more, with a resulting number average molecular weight of about 400 or less to 3,000 or more. Preferably, the average number of carbon atoms per polyalkene molecule will range from about 50 to about 100, with the polyalkenes having a number average molecular weight of about 600 to about 1,500. More preferably, the average number of carbon atoms in the polyalkene molecule ranges from about 60 to about 90, and the number average molecular weight ranges from about 800 to 1,300. Further information regarding the preparation of alkenyl succinimides and the succinic anhydride precursors can be had, for example, by reference to U.S. Pat. No. 4,744,921 and the references cited therein.

It is generally advantageous to use a small amount of an inert hydrocarbon diluent in the process to facilitate mixing and handling of the reaction mixture and product. Typically, a mineral oil will be used for this purpose because of its obvious compatibility with the use of the product in lubricating oil combinations. Suitable lubricating oil diluents which can be used include for example, solvent refined 100N, i.e., Cit-Con 100N, and hydrotreated 100N, i.e., RLOP 100N, and the like. The inert hydrocarbon diluent preferably has a viscosity of from about 1 to about 20 cSt at 100° C.

In the general preparation of overbased sulfurized alkylphenates, demulsifiers are frequently added to enhance the hydrolytic stability of the overbased sulfurized alkylphenate and may be similarly employed in the present process if desired. Suitable demulsifiers which can be used include, for example, nonionic detergents such as, for example, sold under the Trademark Triton X-45 and Triton X-100 by Rohm and Haas (Philadelphia, Pa.) and ethoxylated p-octylphenols. Other suitable commercially available demulsifiers include Igepal CO-610 available from GAF Corporation (New York, N.Y.). Where used, demulsifiers are generally added at from 0.1 to 1 wt % to the alkylphenol, preferably at from 0.1 to 0.5 wt %.

The phenate employed in the present invention may also be prepared as described hereinbelow.

The sulfurized metal phenate mixture is prepared by a two step processing scheme. Some advantages of the two-step process over a single step method include reduced undesired side reactions of the sulfur reactant with the mutual solvent and an improved base reserve.

In a first step an alkylated phenol having from 8 to 35 carbons in the alkyl group is contacted with sulfur and a small amount of an alkaline earth metal oxide or hydroxide and a mutual solvent, preferably ethylene glycol. The reaction of the alkyl phenol, metal base and sulfur proceeds substantially as shown in the following chemical equation:

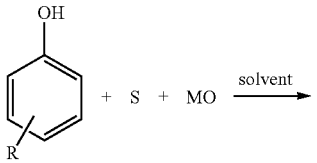

-continued

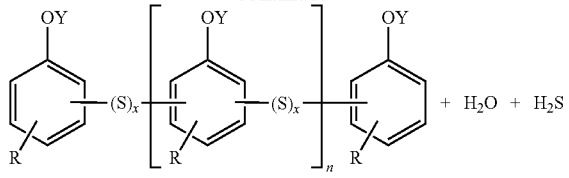

Wherein R is an alkyl group having from 8 to 35 carbons; x is an integer from 1 to 5, n is an integer from 0 to 15, Y is the same or different constituent selected from H or ~M where the ratio of H to ~M is proportional to the ratio of M to alkyl phenol reacted; and M is an alkaline earth metal. The above equation represents a broad and simplified version of both the reaction between the alkyl phenol, sulfur and metal base and the sulfurized intermediate reaction product. The intermediate is not a pure compound having only one single structure, but, rather, is a mixture of numerous sulfurized compounds where n and have several values. The above formula indicates that a metal atom is bonded to or associated with at least one phenolic group in each molecule of the intermediate. However, because the composition is a mixture of compounds, it is recognized that some molecules of sulfurized alkylphenol may not be bonded to or associated with a metal atom. Inversely, other molecules may have all of the phenolic groups neutralized by the metal base. The metal atoms may be bonded to the phenolic group through a covalent bond or ionized and exist as cations within the intermediate product mixture. Thus, it is apparent that while the above chemical equation represents a general description of the reaction and the intermediate reaction product, it should not be interpreted as limiting the invention to the exact structure as shown.

The concentration of alkyl phenol, alkaline earth metal base, sulfur and mutual solvent within the inert reaction diluent during the reaction is not important and may vary with the selection of reactants and process conditions, etc. Generally, however, the concentration of the various components within the inert reaction medium varies as shown in the following Table 1.

TABLE 1

| Component | Broad Range | Preferred Range |
|---|---|---|
| Alkyl phenol | 8.7-47 | 16-35 |
| Alkaline earth metal base | 0.5-42 | 3.8-27 |
| Sulfur | 13-81 | 33-68 |
| Mutual Solvent | 1.3-66 | 3.8-27 |
| Reaction Diluent (wt. percent) | 0-75 | 0-50 |

1 Excluding the Reaction Diluent.

The molar ratio of the various components is an important aspect in the practice of the claimed invention and must be followed in order to realize the critical sulfur:metal ratio in the final sulfurized metal phenate product. The ratios should be maintained as follows: 1 to 5 mols and preferably 1.5 to 3 mols of sulfur, 0.03 to 1.5 mols and preferably from 0.2 to 1 mol of alkaline earth metal base and 0.1 to 4 mols and preferably 0.2 to 1 mol of mutual solvent per mol of alkyl phenol. Excellent results can be realized when 2 mols of sulfur, 0.3 mol of alkaline earth metal base and 0.2 mol of mutual solvent per mol of alkyl phenol are employed within the reaction medium. In a preferred first step processing scheme, the sulfur, alkyl phenol and alkaline earth metal base are charged to a reaction vessel equipped with a vent line and vacuum pump. The reactor contents are heated to 250-285° F. under atmospheric pressure and the mutual solvent is charged to the reaction over a 16-30 minute period. During this time, hydrogen sulfide and water are evolved and are removed from the system through the vent line. The reaction is maintained at 265-285° F. for a period of 1 to 2 hours and then heated to a temperature of 350-365° F. for an additional 3 to 5 hours. At the end of the period, the reactor contents are cooled and a reaction diluents are charged to the reactor.

The sulfurized intermediate at this point contains some elemental or polysulfide sulfur (generally 2 to 10 weight percent) and is ready for use in the second processing step, although it is recognized that it may be filtered to remove any particulate matter or subjected to other purification steps or stored for later use. The above processing step may be performed by either continuous or batch processing method, however, for purposes of illustration, the following discussion is related.

In the second processing step, the sulfurized intermediate is contacted with an additional amount of alkaline earth metal base and mutual solvent. This step, like the first step, may be performed by batch or continuous processing means. For purposes of illustration, the following to the preferred batch processing. The sulfurized intermediate is charged to the reactor along with the reaction solvent, usually a diluent oil, an alkaline earth metal base. The three components are vigorously agitated to disperse the metal base throughout the mixture. The mutual solvent is thereafter introduced into the admixture and catalyzes the exothermic reaction. Upon contacting the reaction medium, hydrogen sulfide and water vapor begin to evolve and are immediately taken off overhead. The delayed removal of the hydrogen sulfide and water vapor encourages the oxidation of some of the mutual solvents, such as ethylene glycol to glycolic acid, oxalic acid, etc., which in turn react with the metal base and reduce the base reserve of the product.

The reaction conditions which can be employed in this step can comprise temperatures between about 250 and 450° F. and preferably between 275 and 400° F. and pressures between 2 and 15 p.s.i.a. and preferably between 2 and 10 p.s.i.a. The time required to neutralize the sulfurized intermediate with the metal base varies depending upon the reactants and mutual solvent selected, the concentrations employed, reaction conditions, etc. Generally, however, the reaction is completed after approximately 4 to 10 hours. At the end of the reaction or concurrent with it, the mutual solvent is preferably stripped from the product.

The concentration of the sulfurized intermediate, alkaline earth metal base and mutual solvent within the reaction is not critical to the practice of this invention except that sufficient diluents is preferably employed to accommodate mixing and pumping of the product. The ratio of the components, on the other hand, is important and should be within the following ranges from 0 to 1.45 mols and preferably from 0.2 to 0.6 mol of alkaline earth metal base and from 0.5 to 4 mols and preferably from 0.5 to 2 mols of total mutual solvent present per mol of original alkylphenol employed. The following Table 2 illustrates the ratios of components employed:

| Component | Broad Range | Preferred Range |
|---|---|---|
| Alkyl phenol (from SI[2]) | 15-67 | 28-67 |
| Alkaline earth metal base added | 0-49 | 6-29 |
| Mutual Solvent | 17-80 | 24-63 |
| Reaction Diluent (wt. percent) | 0-75 | 1-50 |

1 Excluding reaction diluent.
[2]SI represents sulfurized intermediate.

The final product has a metal content which ranges from 0.5 to 15 weight percent and a sulfur content 3.5 to 10 weight percent. The sulfur to metal molar ratio caries from 10 4 and preferably from 1.1 to 4 and more preferably from 1.1 to 2. The alkalinity value (ASTM Test D-2896) of the sulfurized metal phenate ranges from 35 to 200 mg KOH/gram and more usually from 90 to 150 mg KOH/gram by pumping operations and the like. Mineral lubricating oils are preferred.

Alkylated Phenol

The alkylated phenols useful in this invention are of the formula:

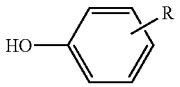

wherein R may be a straight chain or branched-chained alkyl group having from 8 to 35 carbon atoms and preferably from 10 to 30 carbon atoms. The R group or alkyl group may be present on any of the sites around the phenolic ring, i.e., ortho, meta or para. Preferably, the R groups will predominantly be meta or para: That is, less than 40 percent of the R groups will be in the ortho position and preferably less than 15 percent of the R groups will be in the ortho position. A particularly preferred alkylated phenol is polypropylene phenol, having from 9 to 20 carbon atoms in the polypropylene group. Examples of suitable alkyls include, octyl, decyl, dodecyl, ethylhexyl, triacontyl, etc.; radicals derived from petroleum hydrocarbons such as white oil, wax, olefin polymers (e.g. polypropylene, polybutylene, etc.), etc. While one specific structure is indicated by the above formula, it should be recognized that mixtures of alkylated phenols can be successfully employed in the practice of this invention.

Alkaline Earth Metal Base

Several of the alkaline earth metal hydroxides or oxides may be employed in this invention. Exemplary compounds include calcium hydroxide, calcium oxide, barium hydroxide, barium oxide, etc.

Combinations of the oxides and hydroxides of different alkaline earth metals may also be water-insoluble organic medium which would not react or interfere with the reaction of the process would be suitable. A particularly preferred reaction diluent is refined mid-continental neutral oil having a viscosity of about 100 SUS at 1000° F.

Alternatively, the phenate detergents may be prepared by other methods that are well known in the art and that result in a TBN of the phenate detergents in the ranges of 60 to 200 and 200 to 400. The lubricating oil additive composition may also comprise other additives described below. These additional components can be blended in any order and can be blended as combinations of components.

Other Additive Components

The following additive components are examples of some of the components that may employed in the present invention. These examples of additives are provided to illustrate the present invention, but they are not intended to limit it:

A. Metal Detergents

Sulfurized or unsulfurized alkyl or alkenyl phenates, sulfonates derived from synthetic or natural feedstocks, carboxylates, salicylates, phenalates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic, acids, metal salts of an alkyl or alkenyl multiacid, and chemical and physical mixtures thereof.

B. Anti-Oxidants

Anti-oxidants reduce the tendency of mineral oils to deteriorate in service which deterioration is evidenced by the products of oxidation such as sludge and varnish-like deposits on the metal surfaces and by an increase in viscosity. Anti-oxidants may include, but are not limited to, such anti-oxidants as phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butyldene-bis(3-methyl-6-tert-butyl phenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-methylene-bis(4-methyl-6-cyclohexylphenol), 2,6-di-tert-butyl-1-4-methylphenol, 2,6-di-tert-butyl-4-ethylphenol, 2,4-dimethyl-6-tert-butylphenol, 2,6-di-tert-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis(3,5-di-tert-butyl-4-hydroxybenzyl). Diphenylamine-type oxidation inhibitors include, but are not limited to, alkylated diphenylamine, phenyl-.alpha.-naphthylamine, and alkylated-.alpha.-naphthylamine. Other types of oxidation inhibitors include metal dithiocarbamate (e.g., zinc dithiocarbamate), and methylenebis(dibutyldithiocarbamate). The anti-oxidant is generally incorporated into an oil in an amount of about 0 to about 10 wt %, preferably 0.05 to about 3.0 wt %, per total amount of the engine oil.

C. Anti-Wear/Extreme Pressure Agents

As their name implies, these agents reduce wear of moving metallic parts. Examples of such agents include, but are not limited to, phosphates, phosphites, carbamates, esters, sulfur containing compounds, molybdenum complexes, zinc dialkyldithiophosphate (primary alkyl, secondary alkyl, and aryl type), sulfurized oils, sulfurized isobutylene, sulfurized polybutene, diphenyl sulfide, methyl trichlorostearate, chlorinated naphthalene, fluoroalkylpolysiloxane, and lead naphthenate.

D. Rust Inhibitors (Anti-Rust Agents)

1) Nonionic polyoxyethylene surface active agents: polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol monooleate, and polyethylene glycol monooleate.
2) Other compounds: stearic acid and other fatty acids, dicarboxylic acids, metal soaps, fatty acid amine salts, metal salts of heavy sulfonic acid, partial carboxylic acid ester of polyhydric alcohol, and phosphoric ester.

E. Demulsifiers

Addition product of alkylphenol and ethylene oxide, polyoxyethylene alkyl ether, and polyoxyethylene sorbitan ester.

F. Friction Modifiers

Fatty alcohols, 1,2-diols, borated 1,2-diols, fatty acids, amines, fatty acid amides, borated esters, and other esters.

G. Multifunctional Additives

Sulfurized oxymolybdenum dithiocarbamate, sulfurized oxymolybdenum organo phosphorodithioate, oxymolybdenum monoglyceride, oxymolybdenum diethylate amide, amine-molybdenum complex compound, and sulfur-containing molybdenum complex compound.

H. Viscosity Index Improvers or Thickeners

Polymethacrylate type polymers, ethylene-propylene copolymers, styrene-isoprene copolymers, hydrogenated styrene-isoprene copolymers, polyisobutylene, and dispersant type viscosity index improvers.

I. Pour Point Depressants

Polymethyl methacrylate.

J. Foam Inhibitors

Alkyl methacrylate polymers and dimethyl silicone polymers.

K. Metal Deactivators

Disalicylidene propylenediamine, triazole derivatives, mercaptobenzothiazoles, thiadiazole derivatives, and mercaptobenzimidazoles.

L. Dispersants

Alkenyl succinimides, alkenyl succinimides modified with other organic compounds, alkenyl succinimides modified by post-treatment with ethylene carbonate or boric acid, esters of polyalcohols and polyisobutenyl succinic anhydride, phenate-salicylates and their post-treated analogs, alkali metal or mixed alkali metal, alkaline earth metal borates, dispersions of hydrated alkali metal borates, dispersions of alkaline-earth metal borates, polyamide ashless dispersants and the like or mixtures of such dispersants. Preferably, the alkenyl succinimide is a polyalkenyl succinimide. More preferably, a polyisobutenyl succinimide, wherein the polyisobutentyl group has a molecular weight of from about 1000 to about 2300. The alkenyl succinimide is prepared according methods that are well known in the art.

Lubricating Oil Composition

In one embodiment, the invention is directed to a lubricating oil composition comprising the lubricating oil additive composition that was described herein above and an oil of lubricating viscosity.

Oil of Lubricating Viscosity

The lubricating oil additive composition described above is generally added to a base oil that is sufficient to lubricate moving parts, for example internal combustion engines, gears, and transmissions. Typically, the lubricating oil composition of the present invention comprises a major amount of an oil of lubricating viscosity and a minor amount of the lubricating oil additive composition.

The base oil employed may be any of a wide variety of oils of lubricating viscosity. The base oil of lubricating viscosity used in such compositions may be mineral oils or synthetic oils. A base oil having a viscosity of at least 2.5 cSt at 40° C. and a pour point below 20° C., preferably at or below 0° C., is desirable. The base oils may be derived from synthetic or natural sources.

Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, polyalpha-olefin or PAO oils, or oils prepared from hydrocarbon synthesis procedures using carbon monoxide and hydrogen gases such as in a Fisher-Tropsch process. Useful synthetic hydrocarbon oils include liquid polymers of alpha olefins having the proper viscosity. Especially useful are the hydrogenated liquid oligomers of C.sub.6 to C.sub.12 alpha olefins such as 1-decene trimer. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils.

Additive Packages

In another embodiment, the invention is directed to additive concentrates for engine oils that contain at a carboxylate detergent, a first phenate detergent, a second phenate detergent and a polyalkenyl succinimide. In another embodiment, the invention is directed to additive concentrates for engine oils that contain a carboxylate detergent having a TBN of from about 60 to about 200; a first phenate detergent having a TBN of from about 60 to 200; a second phenate detergent having a TBN of from about 200 to 400; and a polyalkenyl succinimide. The lubricating oil additive composition, which is described herein above, concentrate may be provided as an additive package or concentrate which will be incorporated into a substantially inert, normally liquid organic diluent such as, for example, mineral oil, naphtha, benzene, toluene or xylene to form an additive concentrate. These concentrates usually contain from about 1% to about 99% by weight, and in one embodiment about 10% to about 90% by weight of such diluent. Typically, a neutral oil having a viscosity of about 4 to about 8.5 cSt at 100° C. and preferably about 4 to about 6 cSt at 100° C. will be used as the diluent, though synthetic oils, as well as other organic liquids which are compatible with the additives and finished lubricating oil can also be used.

One embodiment of the invention is directed to a method for operating a diesel locomotive engine comprising lubricating a diesel locomotive engine with a lubricating oil composition comprising a major amount of an oil of lubricating viscosity and the lubricating oil additive package described hereinabove, which contains a carboxylate detergent, a first phenate detergent, a second phenate detergent and a polyalkenyl succinimide.

One embodiment of the invention is directed to a method for operating an inland marine engine comprising lubricating an inland marine engine with a lubricating oil composition comprising a major amount of an oil of lubricating viscosity and the lubricating oil additive package described hereinabove, which contains a carboxylate detergent, a first phenate detergent, a second phenate detergent and a polyalkenyl succinimide.

One embodiment of the invention is directed to a method of improving TBN retention wherein the lubricating oil composition comprises a major amount of an oil of lubricating viscosity and the lubricating oil additive package described hereinabove, which contains a carboxylate detergent, a first phenate detergent, a second phenate detergent and a polyalkenyl succinimide.

EXAMPLES

Base Lubricating Oil Composition

A lubricating oil composition was prepared by blending a polyisobutenyl succinimide, wherein the polyisobutenyl group has a molecular weight of 2300, a 263 TBN oil concentrate of a phenate detergent, a 114 TBN oil concentrate of a phenate detergent, a calcium salt of a Mannich base alkylphenol, at least one antioxidant, a foam inhibitor, and a Group I base oil.

Comparative Examples 1-8 were comprised primarily of the Base Lubricating Oil Composition (see Table 1). Examples 1-4 (Examples of the Invention) comprised the Base Lubricating Oil Composition and at least one of a 140 TBN oil concentrate of a single-ring carboxylate or a 150 TBN oil concentrate of a carboxylate detergent (See Table 2).

Each of the comparative oils and oils of the invention was tested in the B2-7 which is otherwise known as the Union Pacific Oxidation Test. This test method is described below.

B2-7 Test/Union Pacific Oxidation Test

The B2-7 test is an oxidation test with the following conditions:

| | UP Oxidation (B2) |
|---|---|
| Temp | 149 C. (300 F.) |
| Duration | 96 hr |
| Coupons | Cu, Fe, Pb |
| Flow | oxygen |
| Replenishing oil | At 48 hr (50 mL)<br>72 hr (50 mL) |
| Comments | Trend data of BN, AN, pH and Pb ppm |

According to the B2-7 test, the oil to be tested is heated at 300° F. for 96 hours with bubbling oxygen. Copper, iron and lead coupons are suspended in the oil. Fifty milliliter samples are taken at 48, 72 and 96 hours. The samples at 48 and 72 hours are replenished with fresh oil. The oil test samples are evaluated for base number, acid number, pH and lead.

TABLE 1

| | Comparative Examples | | | | | | | |
|---|---|---|---|---|---|---|---|---|
| Oil number | Comp 1 | Comp 2 | Comp 3 | Comp 4 | Comp 5 | Comp 6 | Comp 7 | Comp 8 |
| Dispersants | | | | | | | | |
| Ethylene Carbonate treated Succinimide Dispersant (wt %) | 3.000 | 3.000 | 3.000 | 3.000 | 3.000 | 3.000 | 3.000 | 3.000 |
| HOB Detergents | | | | | | | | |
| 263 TBN phenate (mmol) | (22.00) | (22.00) | (22.00) | (22.00) | (30.00) | (30.00) | (30.00) | (30.00) |
| 114 TBN phenate (mmol) | (30.00) | (30.00) | (30.00) | (30.00) | (22.00) | (22.00) | (22.00) | (22.00) |
| 140 TBN single ring carboxylate[1] (mmol) | | | | | | | | |
| 150 TBN[2] carboxylate (mmol) | | | | | | | | |

TABLE 1-continued

| Oil number | Comp 1 | Comp 2 | Comp 3 | Comp 4 | Comp 5 | Comp 6 | Comp 7 | Comp 8 |
|---|---|---|---|---|---|---|---|---|
| Comparative Examples | | | | | | | | |
| Mannich Base (wt %) | 3.000 | 3.000 | 3.000 | 3.000 | 3.000 | 3.000 | 3.000 | 3.000 |
| Antioxidants | | | | | | | | |
| Diphenylamine (wt %) | 1.00 | 1.00 | 1.00 | 1.00 | 1.00 | 1.00 | 1.00 | 1.00 |
| Hindered Phenol (wt %) | 0.00 | 1.00 | 2.00 | 3.00 | 0.00 | 1.00 | 2.00 | 3.00 |
| Molybdenum Oxysulfide (wt %) | 0.20 | 0.20 | 0.20 | 0.20 | 0.20 | 0.20 | 0.20 | 0.20 |
| Foam Inhibitors | | | | | | | | |
| Foam Inhibitor | 3 ppm | 3 ppm | 3 ppm | 3 ppm | 3 ppm | 3 ppm | 3 ppm | 3 ppm |
| B. Oils | | | | | | | | |
| EXXON 150N (wt % of the total base oil) | 5 | 5 | 5 | 5 | 5 | 5 | 5 | 5 |
| EXXON 600N (wt % of the total base oil) | 95 | 95 | 95 | 95 | 95 | 95 | 95 | 95 |
| B2 Test Results | | | | | | | | |
| TBN decrease (mg/KOH) | 5.88 | 5.47 | 5.16 | 5.33 | 5.11 | 5.5 | 5.34 | 5.06 |
| Pb (ppm) | 545 | 578 | 647 | 464 | 406 | 925 | 334 | 331 |

[1]Prepared according to U.S. Published Patent Application No. 2007/0105730
[2]Prepared according to U.S. Published Patent Application No. 2007/0027043

TABLE 2

| Oil number | Ex 1 | Ex 2 | Ex 3 | Ex 4 |
|---|---|---|---|---|
| Examples of the Invention | | | | |
| Dispersants | | | | |
| Succinimide Ethylene Carbonate treated Succinimide Dispersant (wt %) | 3.000 | 3.000 | 3.000 | 3.000 |
| HOB Detergents | | | | |
| 263 TBN phenate (mmol) | (22.00) | (22.00) | (22.00) | (22.00) |
| 114 TBN phenate (mmol) | (22.00) | (22.00) | (22.00) | (22.00) |
| 140 TBN single ring carboxylate[3] (mmol) | | | (22.00) | (22.00) |
| 150 TBN carboxylate[4] (mmol) | (22.00) | (22.00) | | |
| Mannich Base (wt %) | 3.000 | 3.000 | 3.000 | 3.000 |
| Antioxidants | | | | |
| Diphenylamine (wt %) | 0.20 | 0.20 | 0.20 | 0.20 |
| Hindered Phenol (wt %) | | 0.50 | | 0.50 |
| Molybdenum Oxysulfide (wt %) | 0.20 | 0.20 | 0.20 | 0.20 |

TABLE 2-continued

| Oil number | Ex 1 | Ex 2 | Ex 3 | Ex 4 |
|---|---|---|---|---|
| Examples of the Invention | | | | |
| Foam Inhibitors | | | | |
| Foam Inhibitor | 3 ppm | 3 ppm | 3 ppm | 3 ppm |
| B. Oils | | | | |
| EXXON 150N (wt % of the total base oil) | 5 | 5 | 5 | 5 |
| EXXON 600N (wt % of the total base oil) | 95 | 95 | 95 | 95 |
| B2 Test Results | | | | |
| TBN decrease (mg/KOH) | 4.17 | 3.99 | 4.95 | 5.15 |
| Pb (ppm) | 52 | 78 | 121 | 133 |

[3]Prepared according to U.S. Published Patent Application No. 2007/0105730
[4]Prepared according to U.S. Published Patent Application No. 2007/0027043

The samples in the comparative examples (Comparative Examples 1-8) and samples in the examples of the invention (Examples 1-4) were evaluated for Total Base Number (TBN) decrease and lead corrosion which is measured as parts per million of lead found in the oil (i.e., Pb ppm).

Higher numbers for TBN decrease indicate greater depletion of the base in the oil and are considered less favorable. Similarly, higher numbers for Pb (ppm) indicate greater lead corrosion and are considered less favorable. An oil for extended use in a locomotive diesel engine will ideally retain TBN and not show corrosion against lead.

B2-7 Results

Based upon the results of the test it is evident that the lubricating oil compositions of the invention Examples 1-4 exhibit lower numbers for TBN decrease, thus indicating that the base in the lubricating oil is not depleted as much as in the Comparative Examples.

Additionally, lead corrosion has decreased in the samples of the oils that are Examples 1-4. The amount of lead corrosion is low, especially when compared to the lead corrosion results of the oils that are Comparative Examples 1-8. Specifically, the lead corrosion measurements of Examples 1-4 (of the invention) show lead measurements that are 10-15% of the measurements for the Comparative Examples.

The lubricating oil compositions comprising at least two phenate detergents and at least one carboxylate detergents show a significant improvement with regard to both BN retention and lead corrosion over oils which do not contain the carboxylates employed in the present invention.

What is claimed is:

1. A lubricating oil additive composition comprising a. at least one carboxylate detergent which is an alkaline earth metal single-aromatic-ring hydrocarbyl carboxylate detergent or an alkaline earth metal alkylhydroxybenzoate detergent, wherein the alkaline earth metal single-aromatic-ring hydrocarbyl carboxylate detergent is of the formula

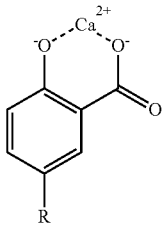

wherein R is a linear hydrocarbyl group, a branched hydrocarbyl group or mixtures thereof; and further wherein at least one of the carboxylate detergents has a TBN of the actives of greater than about 60 to about 200;

b. at least one polyalkenyl succinimide;

c. a first phenate detergent having a TBN of the actives of greater than about 60 to 200;

d. a second phenate detergent having a TBN of the actives of greater than 200 to about 400, wherein at least one of the first and second phenate detergents is a sulfurized phenate detergent; and e. a calcium salt of a Mannich base alkylphenol.

2. The lubricating oil additive composition of claim 1 wherein the polyalkenyl succinimide is a polyisobutenyl succinimide.

3. The lubricating oil additive composition of claim 1 wherein the first phenate detergent is an alkaline earth metal phenate detergent.

4. The lubricating oil additive composition of claim 3 wherein the alkaline earth metal phenate detergent is a calcium phenate detergent.

5. The lubricating oil additive composition of claim 1 wherein the second phenate detergent is an alkaline earth metal phenate detergent.

6. The lubricating oil additive composition of claim 5 wherein the alkaline earth metal phenate detergent is a calcium phenate detergent.

7. A lubricating oil composition comprising a. a major amount of oil of lubricating viscosity;

b. at least one carboxylate detergent which is an alkaline earth metal single-aromatic-ring hydrocarbyl carboxylate detergent or an alkaline earth metal alkylhyroxybenzoate detergent, wherein the alkaline earth metal single-aromatic-ring hydrocarbyl carboxylate detergent is of the formula

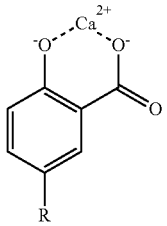

wherein R is a linear hydrocarbyl group, a branched hydrocarbyl group or mixtures thereof; and further wherein at least one of the carboxylate detergents has a TBN of the actives of greater than about 60 to about 200;

c. at least one polyalkenyl succinimide;

d. a first phenate detergent having a TBN of the actives of greater than about 60 to 200;

e. a second phenate detergent having a TBN of the actives of greater than 200 to about 400, wherein at least one of the first and second phenate detergents is a sulfurized phenate detergent; and f. a calcium salt of a Mannich base alkylphenol.

8. The lubricating oil composition of claim 7 wherein the lubricating oil composition is a railroad engine oil.

9. A method for operating a diesel locomotive engine comprising lubricating said diesel locomotive engine with a lubricating oil composition comprising a. a major amount of an oil of lubricating viscosity;

b. at least one carboxylate detergent which is an alkaline earth metal single-aromatic-ring hydrocarbyl carboxylate detergent or an alkaline earth metal alkylhydroxybenzoate detergent, wherein the alkaline earth metal single-aromatic-ring hydrocarbyl carboxylate deterent is of the formula

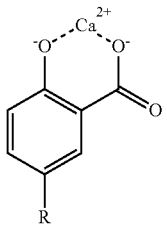

wherein R is a linear hydrocarbyl group, a branched hydrocarbyl group or mixtures thereof, and further wherein at least one of the carboxylate detergents has a TBN of the actives of greater than about 60 to about 200;

c. at least one polyalkenyl succinimide;

d. a first phenate detergent having a TBN of the actives of greater than about 60 to 200;

e. a second phenate detergent having a TBN of the actives of greater than 200 to about 400, wherein at least one of the first and second phenate detergents is a sulfurized phenate detergent; and f. a calcium salt of a Mannich base alkylphenol.

10. A method for operating an inland marine engine comprising lubricating said inland marine engine with a lubricating oil composition comprising a. a major amount of an oil of lubricating viscosity; and b. at least one carboxylate detergent which is an alkaline earth metal single-aromatic-ring hydrocarbyl carboxylate detergent or an alkaline earth metal alkylhydroxybenzoate detergent, wherein the alkaline earth metal single-aromatic-ring hydrocarbyl carboxylate detergent is of the formula

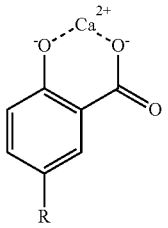

wherein R is a linear hydrocarbyl group, a branched hydrocarbyl group or mixtures thereof, and further wherein at least one of the carboxylate detergents has a TBN of the actives of greater than about 60 to about 200;

c. at least one polyalkenyl succinimide;

d. a first phenate detergent having a TBN of the actives of greater than about 60 to 200 e. a second phenate detergent having a TBN of the actives of greater than 200 to about 400, wherein at least one of the first and second phenate detergents is a sulfurized phenate detergent; and f. a calcium salt of a Mannich base alkylphenol.

11. A method of improving TBN retention comprising lubricating an engine with a lubricating oil composition having a. a major amount of an oil of lubricating viscosity;

b. at least one carboxylate detergent which is an alkaline earth metal single-aromatic-ring hydrocarbyl carboxylate detergent or an alkaline earth metal alkylhydroxybenzoate detergent, wherein the alkaline earth metal single-aromatic-ring hydrocarbyl carboxylate detergent is of the formula

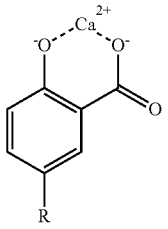

wherein R is a linear hydrocarbyl group, a branched hydrocarbyl group or mixtures thereof; and further wherein at least one of the carboxylate detergents has a TBN of the actives of greater than about 60 to about 200;

c. at least one polyalkenyl succinimide;

d. a first phenate detergent having a TBN of the actives of greater than about 60 to 200;

e. a second phenate detergent having a TBN of the actives of greater than 200 to about 400, wherein at least one of the first and second phenate detergents is a sulfurized phenate detergent; and f. a calcium salt of a Mannich base alkylphenol.

12. The lubricating oil additive composition of claim 1 wherein the polyalkenyl succinimide is an ethylene carbonate treated polyalkenyl succinimide.

13. The lubricating oil additive composition of claim 1 wherein the first phenate detergent is a sulfurized phenate detergent.

14. The lubricating oil additive composition of claim 1 wherein the second phenate detergent is a sulfurized phenate detergent.

15. The lubricating oil additive composition of claim 1 wherein the first and second phenate detergents are sulfurized phenate detergents.

16. The lubricating oil composition of claim 7, wherein the polyalkenyl succinimide is an ethylene carbonate treated polyalkenyl succinimide.

17. The lubricating oil composition of claim 7, wherein the first and second phenate detergents are sulfurized phenate detergents.

18. The lubricating oil composition of claim 7, wherein the polyalkenyl succinimide is an ethylene carbonate treated polyalkenyl succinimide and the first and second phenate detergents are sulfurized phenate detergents.

19. The lubricating oil composition of claim 7, further comprising a lubricating oil additive selected from the group consisting of an anti-oxidant, anti-wear agent, extreme pressure agent, rust inhibitor, demulsifier, friction modifier, multifunctional additive, viscosity index improver, pour point depressant, foam inhibitor, metal deactivator, dispersant other than the polyalkenyl succinimide and mixtures thereof.

20. The method of claim 9, wherein the polyalkenyl succinimide is an ethylene carbonate treated polyalkenyl succinimide.

21. The method of claim 9, wherein the first and second phenate detergents are sulfurized phenate detergents.

22. The method of claim 9, wherein the polyalkenyl succinimide is an ethylene carbonate treated polyalkenyl succinimide and the second phenate detergent is a sulfurized phenate detergent.

23. The method of claim 10, wherein the polyalkenyl succinimide is an ethylene carbonate treated polyalkenyl succinimide and the first and second phenate detergents are sulfurized phenate detergents.

24. The method of claim 11, wherein the polyalkenyl succinimide is an ethylene carbonate treated polyalkenyl succinimide and the first and second phenate detergents are sulfurized phenate detergents.

* * * * *